US006280139B1

(12) United States Patent
Romani et al.

(10) Patent No.: US 6,280,139 B1
(45) Date of Patent: Aug. 28, 2001

(54) RADIAL SPLIT DIFFUSER

(75) Inventors: Giuseppe Romani, Mississauga; Jan Honza Stastny, Georgetown; Grigory Rukin, Thornhill, all of (CA)

(73) Assignee: Pratt & Whitney Canada Corp., Longueuil (CA)

( * ) Notice: Subject to any disclaimer, the term of this patent is extended or adjusted under 35 U.S.C. 154(b) by 0 days.

(21) Appl. No.: 09/419,902

(22) Filed: Oct. 18, 1999

(51) Int. Cl.[7] ..... F01D 1/02

(52) U.S. Cl. ..... 415/207; 415/208.3; 415/211.2; 415/224.5; 415/226

(58) Field of Search ..... 415/207, 208.2, 415/208.3, 211.1, 211.2, 214.1, 215.1, 224.5, 226

(56) References Cited

U.S. PATENT DOCUMENTS

| | | | | |
|---|---|---|---|---|
| 3,333,762 | * | 8/1967 | Vrana | 415/207 |
| 3,719,430 | * | 3/1973 | Blair et al. | 415/207 |
| 3,832,089 | | 8/1974 | Moellmann . | |
| 4,027,997 | * | 6/1977 | Bryans | 415/207 |
| 4,966,523 | * | 10/1990 | Sherikar | 415/208.4 |
| 5,428,952 | * | 7/1995 | Jewess | 60/39.31 |
| 6,123,506 | * | 9/2000 | Brand et al. | 415/208.3 |

FOREIGN PATENT DOCUMENTS

| | | |
|---|---|---|
| 914420 | 10/1946 | (FR) . |
| 587511 | 5/1947 | (GB) . |
| 1205514 | 9/1970 | (GB) . |

* cited by examiner

*Primary Examiner*—Edward K. Look
*Assistant Examiner*—Ninh Nguyen
(74) *Attorney, Agent, or Firm*—Jeffrey W. Astle

(57) ABSTRACT

The invention relates to a radial split diffuser with an inner casing and an outer casing joined together along a cylindrical joint. Each diffuser passage is intersected by and extends transversely across the joint. The advantages of this design include: the elimination of a transition within the initial portion of the passages where air flow speeds are supersonic and minute surface discontinuities can significantly effect performance; and the simplification of manufacturing through use of metal castings to replace sheet metal fabrications in the manufacture of diffusers. The joint in the present invention can be located downstream from the diffuser inlet a sufficient distance in a lower velocity area. The joint is located to enable access for precise machining of the critical initial portion of the passages within the inner casing, and to minimize air flow disturbance in the initial portion.

19 Claims, 6 Drawing Sheets

RADIAL SPLIT DIFFUSER

TECHNICAL FIELD

The invention is directed to an annular diffuser for a gas turbine engine that is split into an inner diffuser casing and an outer diffuser casing along a cylindrical joint, thereby simplifying the fabrication and machining of the highly accurate compressed air passages over conventional diffuser designs, reducing vibration, reducing air flow efficiency losses in the diffuser passages and enabling the structural integration of the diffuser with the gas generator casing structure.

BACKGROUND OF THE ART

The compressor section of a conventional gas turbine engine usually includes a diffuser located downstream of the centrifugal compressor turbines and impeller, and upstream of the combustor. The function of a diffuser is to reduce the velocity of the compressed air and simultaneously increase the static pressure thereby preparing the air for entry into the combustor at a low velocity and high pressure. High-pressure low velocity air presented to the combustor section is essential for proper fuel mixing and efficient combustion.

Gas turbine engines that include a centrifugal impeller as the high-pressure stage of the compressor are suitable for application of the present invention. Centrifugal impellers are used generally in smaller gas turbine engines. A compressor section may include axial or mixed flow compressor stages with the centrifugal impeller as the high-pressure section or alternatively a low-pressure impeller and high-pressure impeller may be joined in series.

The centrifugal compressor impeller draws air axially from a low diameter. Rotation of the impeller increases the velocity of the air flow as the input air is directed over impeller vanes to flow in a radially outward direction under centrifugal force. In order to redirect the radial flow of air exiting the impeller to an annular axial flow for annular presentation to the combustor, a diffuser assembly is provided to redirect the air from radial to axial flow and to reduce the velocity and increase static pressure.

A conventional diffuser assembly generally comprises a machined ring which surrounds the periphery of the impeller for capturing the radial flow of air and redirecting it through generally tangential orifices into an array of separate diffuser tubes. The diffuser tubes are generally horn-shaped with an increasing internal cross-section and bend to direct air from the radial to axial direction. The diffuser tubes are formed of sheet metal with a longitudinal seam. The narrow end of the diffuser tubes are brazed or mechanically connected to the central ring and have an increasing cross-section rearwardly. As a result, the narrow stream of air at high pressure taken into the orifices in the ring are expanded in volume as the air travels axially through the diffuser tubes. The increase in air volume results in a reduced velocity and corresponding increase in static pressure, (i.e.: kinetic energy is converted to pressure energy, where total energy of a fluid flow remains constant being the sum of the pressure energy, potential energy and kinetic energy, Bernoulli theorem)

Fabrication of the conventional diffuser with individual tubes is extremely complex since the tubes have a flared internal pathway that curves from a generally radial tangential direction to an axial rearward direction. Each tube must be manufactured to close tolerances individually and then assembled to the machined central ring. Complex tooling and labour intensive manufacturing procedures result in a relatively high cost for preparation of the diffusers.

During engine operation, diffusers often cause problems resulting from the vibration of the individual diffuser tubes. Vibration can cause a reduction in service life due to metal fatigue, causes instability in the engine compressed air flow, and adds to the engine noise. To remedy vibration difficulties, the diffuser tubes may be joined together or may be balanced during routine maintenance. However, such operations are labour intensive, and involve costly down-time for the engine. From an aerodynamic standpoint, the joining of individual diffuser tubes to the machined central ring results in interior surface transitions that inevitably effect the efficiency of the engine detrimentally due to the high velocity of air flow. On the interior of the tube as it joins the orifice in the ring, there is a step or transition caused by manufacturing tolerances in the assembly and brazing procedures. Since the air in this section flows at supersonic velocity, even minute disturbances in air flow and increases in drag as the air flows over such transitions can result in very high losses in efficiency.

In general, the design of diffusers is not optimal since their complex structure requires a compromise between the desired aerodynamic properties and the practical limits of manufacturing procedures. For example, the orifices in the impeller surrounding ring are limited in shape to cylindrical bores or conical bores due to the limits of economical drilling procedures. To provide elliptical holes for example, would involve prohibitively high costs in preparation and quality control. The shape of the diffuser pipes themselves is also limited by the practical considerations of forming their complex geometry. In general, the diffuser tubes are made in a conical shape and bent to their helical final shape prior to brazing. Whether or not this conical configuration is optimal for aerodynamic efficiency becomes secondary to the practical considerations of economical manufacturing.

Diffuser designs incorporating multiple diffuser tubes have the advantage that oil lines can easily be passed between adjacent tubes through the diffuser. As a result, bearings can be located adjacent the combustor area to support the high pressure shaft where loading is most critical. The disadvantages inherent in a complex diffuser design are justified by the advantages inherent in centrifugal compressor efficiency and preferred bearing locations, particularly in small engines.

Due to the radial extent of the combined centrifugal compressor and diffuser, together with any external bypass ducts, the diameter of the diffuser assembly contributes significantly to the overall diameter of the entire engine. Reduction in the diameter of the diffuser assembly can result in reduction of engine diameter which significantly effects the drag and fuel efficiency of an aircraft.

It is an object of the invention to provide a diffuser assembly which significantly reduces the tooling and manufacturing costs associated with prior art diffuser assemblies, thereby reducing costs and manufacturing time.

It is an object of the invention to significantly reduce the losses in efficiency that result from locating transitions in areas of the diffuser passages carrying high velocity air flow.

It is an object of the invention to reduce the vibration difficulties and the number of parts resulting from use of multiple independent diffuser tubes.

It is an object of the invention to rationalize the various components of a conventional diffuser design and adjacent engine structures into a more compact structurally integral robust unit, preferably with reduced overall diameter.

Further objects of the invention will be apparent from review of the disclosure and description of the invention below.

DISCLOSURE OF THE INVENTION

The invention relates to a radial split diffuser with an inner casing and an outer casing joined together along a cylindrical joint. Each diffuser passage is intersected by and extends transversely across the joint.

An advantage of this design include: the elimination of a transition within the initial portion of the passages where air flow speeds are supersonic and minute surface discontinuities can significantly effect performance. Further advantage is achieved through the simplification of manufacturing by use of robust low cost metal castings to replace labour intensive sheet metal fabrications in the manufacture of diffusers.

The joint in the present invention can be located downstream from the diffuser inlet a sufficient distance within a lower velocity area. A conventional diffuser directs a radially outward flow of compressed air from an impeller of a centrifugal compressor to an axially rearward diffused annular flow.

The split diffuser of the invention has an inner and outer casing manufactured as a casting and machined to be joined along a manufacturing joint by brazing for example into an annular diffuser assembly having a central impeller opening and an outer rim. A number of discrete diffuser passages are cast and machine finished in a circumferential spaced apart array through the diffuser assembly, each passage extending through the diffuser assembly from an inlet in the central opening, across the brazed joint and to an outlet in the rim.

The joint is located to enable access for precise machining of the critical initial portion of the passages within the inner casing, and to minimise air flow disturbance in the initial portion. For example, in conventional diffusers, the initial portion of the passages is machined in a conical shape within a narrow inner ring. The sheet metal diffuser tubes are fitted within the ring with a transition at the joint between tubes and ring relatively close to the inlet where air flow speeds are extremely high. In contrast, the invention provides a relatively wide inner casing with a longer initial portion of the passages machined conically.

The joint with the cast metal outer casing is positioned at a distance from the inlets where the passages have widened to a stage where air flow speeds are lower and the air flow losses resulting from the transition joint are much lower. In addition, the outer casing includes cast passages that are machined conically adjacent the joint to match the passages in the inner casing, and that arc to redirect flow from a radial to an annular flow. The arc portions of the passages are wider and carry air of much lower speed. Hence the requirements of dimensional accuracy and surface finish in the arc passage profile are much reduced permitting the casting of passages and extrude honing in manufacture.

The casting of the outer casing reduces manufacturing costs in significantly reducing the number of parts, however, several other advantages also result such as the freedom to cast diffuser passages of differing profiles. The dynamic instability of separate conventional diffuser tubes is eliminated by the superior structural integrity of the robust inner and outer ring-like casings.

In addition, the casings themselves can be used to form part of the engine gas generator casing structure, thereby eliminating weight and increasing structural strength by combining the diffuser function with the pressure vessel function of the gas generator casing in a single unitary structure. In some cases, the combining of the diffuser with the gas generator casing structure will reduce the overall diameter of the engine assembly.

Further details of the invention and its advantages will be apparent from the detailed description and drawings included below.

BRIEF DESCRIPTION OF THE DRAWINGS

In order that the invention may be readily understood, one preferred embodiment of the invention will be described by way of example, with reference to the accompanying drawings wherein:

FIG. 6 is not to the same scale as FIG. 5).

DETAILED DESCRIPTION OF PREFERRED EMBODIMENTS

Figure 1:
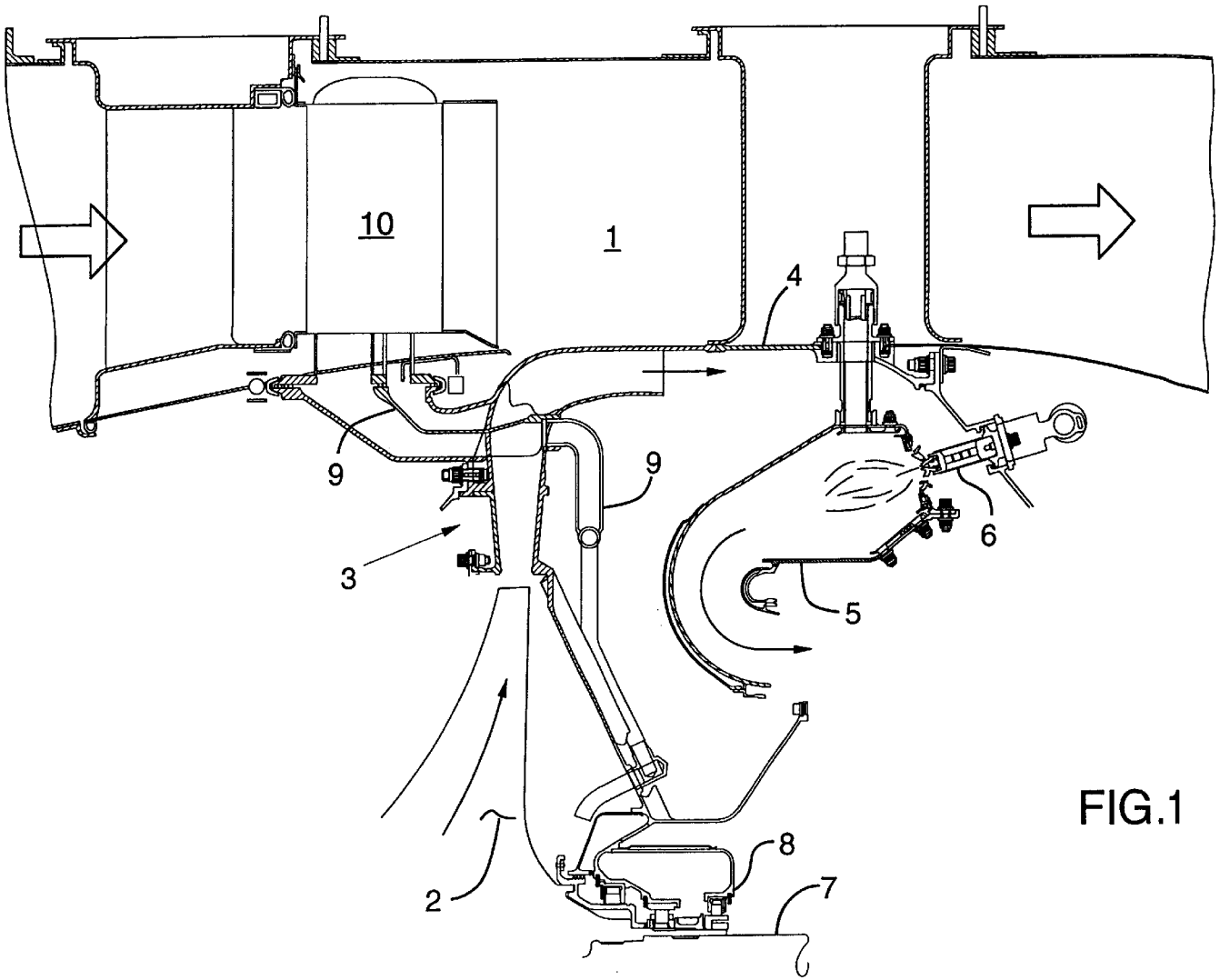
FIG. 1 is a longitudinal cross-section through the gas generator casing of a gas turbine engine showing a segment of the centrifugal impeller, annular diffuser according to the invention, gas generator casing housing the combustor as well as exterior bypass duct and adjacent engine structures.

FIG. 1 illustrates a gas turbine engine structure that is conventional apart from the novel annular diffuser assembly in accordance with the present invention. The engine depicted includes an outward bypass air duct 1, which directs external air rearwardly (as indicated by the arrows) through the action of a forward fan (not shown). An internal flow of air is passed through the compressor section of the engine. The high-pressure centrifugal impeller 2 directs compressed air radially outwardly as indicated by the arrows into the annular diffuser assembly 3.

The diffuser assembly 3 redirects the compressed air from a radial direction to an annular rearward flow into the gas generator casing 4. The diffuser assembly 3 and gas generator casing 4 serve to reduce the velocity of the compressed air thereby increasing its static pressure and containing the high-pressure compressed air within the pressure vessel of the gas generator casing 4. The compressed air within the casing 4 flows through apertures into the combustor 5 where it is mixed with fuel sprayed from the fuel nozzle 6. The ignited fuel and compressed air mixture produces hot gas which is directed as indicated by the arrow rearwardly towards high-pressure turbines (not shown).

In the embodiment shown, the rotating high-pressure shaft 7 is supported on bearings 8 located between the high pressure compressor section and high pressure turbine section. In order to provide oil lubrication to the bearings 8, the embodiment illustrated shows an oil line 9 which passes through the annular diffuser assembly 3 and through a vane 10 in the bypass air duct 1 where it is connected with other components of the oil circulation system such as an oil pump and filter.

Figure 2:
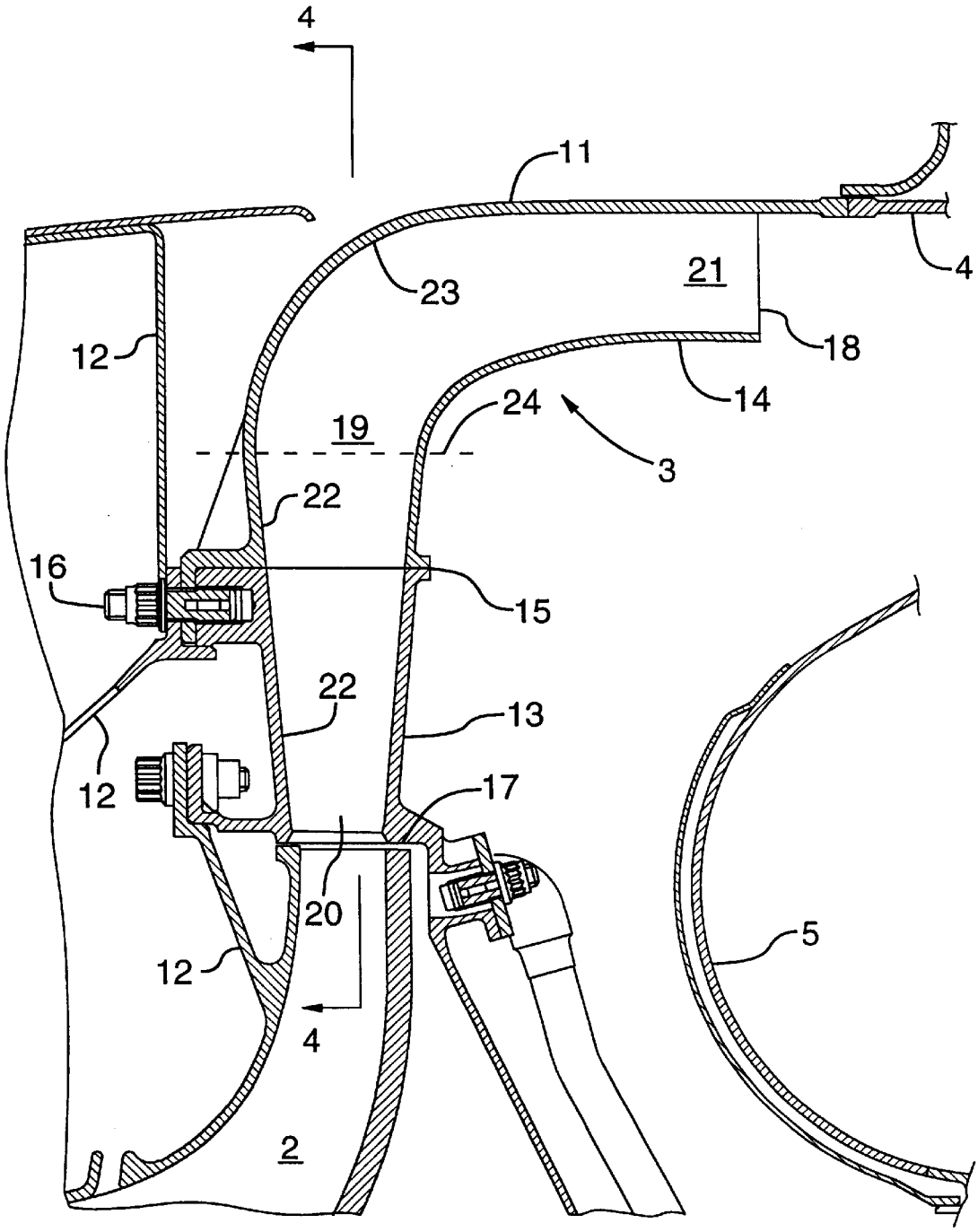
FIG. 2 is longitudinal sectional view through a diffuser assembly according to the invention comprising an inner casing with conical machined diffuser passage secured along a cylindrical joint to an outer casing with arced diffuser passage with transition from a conical profile to a rectangular profile at the rim of the outer casing.

Referring to FIG. 2, a detailed view of one embodiment of the annular diffuser assembly 3 is illustrated. Unlike conventional diffusers, the external wall 11 of the diffuser assembly 3 is continuous with the gas generator casing 4 and is secured to other engine structural components 12. Conventional diffusers are independent of the adjacent gas generator casing and are supported only at their central ring giving rise to vibration considerations in operation.

As a result, the external wall 11 of the invention serves as a pressure vessel wall to contain compressed air in a continuous pressure vessel formed by the gas generator casing 4, the external wall 11 and other engine structures 12. Also the external wall 11 together with the engine structure components 12 serve to carry loads between the engine supports and shafts for example. The diffuser assembly 3 therefore serves as a pressure vessel, an engine support structure component and as a compressed air diffuser. Conventional diffuser assemblies are substantially independent of the engine structure and serve merely to diffuse compressed air. Conventional diffusers suffer from vibration due to their independence from adjacent engine structures.

In contrast, the annular diffuser assembly 3, in accordance with the invention, is constructed of an inner casing 13 and an outer casing 14 which are joined together along a manufacturing joint 15 which is very accurately machined and press fit, braced or secured with fasteners 16 to ensure structural and pressure vessel integrity.

Figure 3:
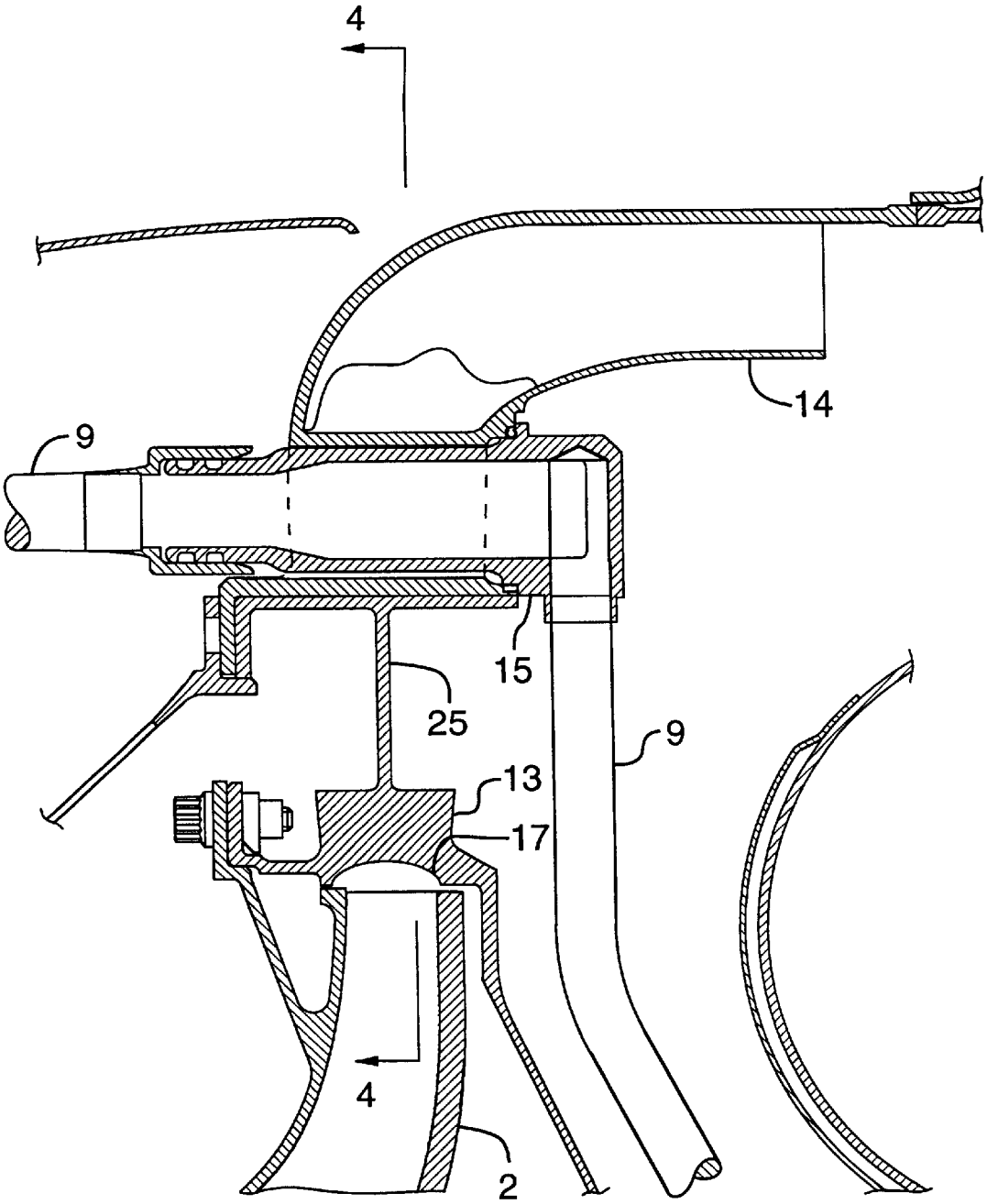
FIG. 3 is a longitudinal sectional view through the diffuser assembly showing in particular the passage of a lubricating oil line through the diffuser between diffuser passages to provide lubricating oil to bearings between the compressor impeller and turbine rotors.
Figure 4:
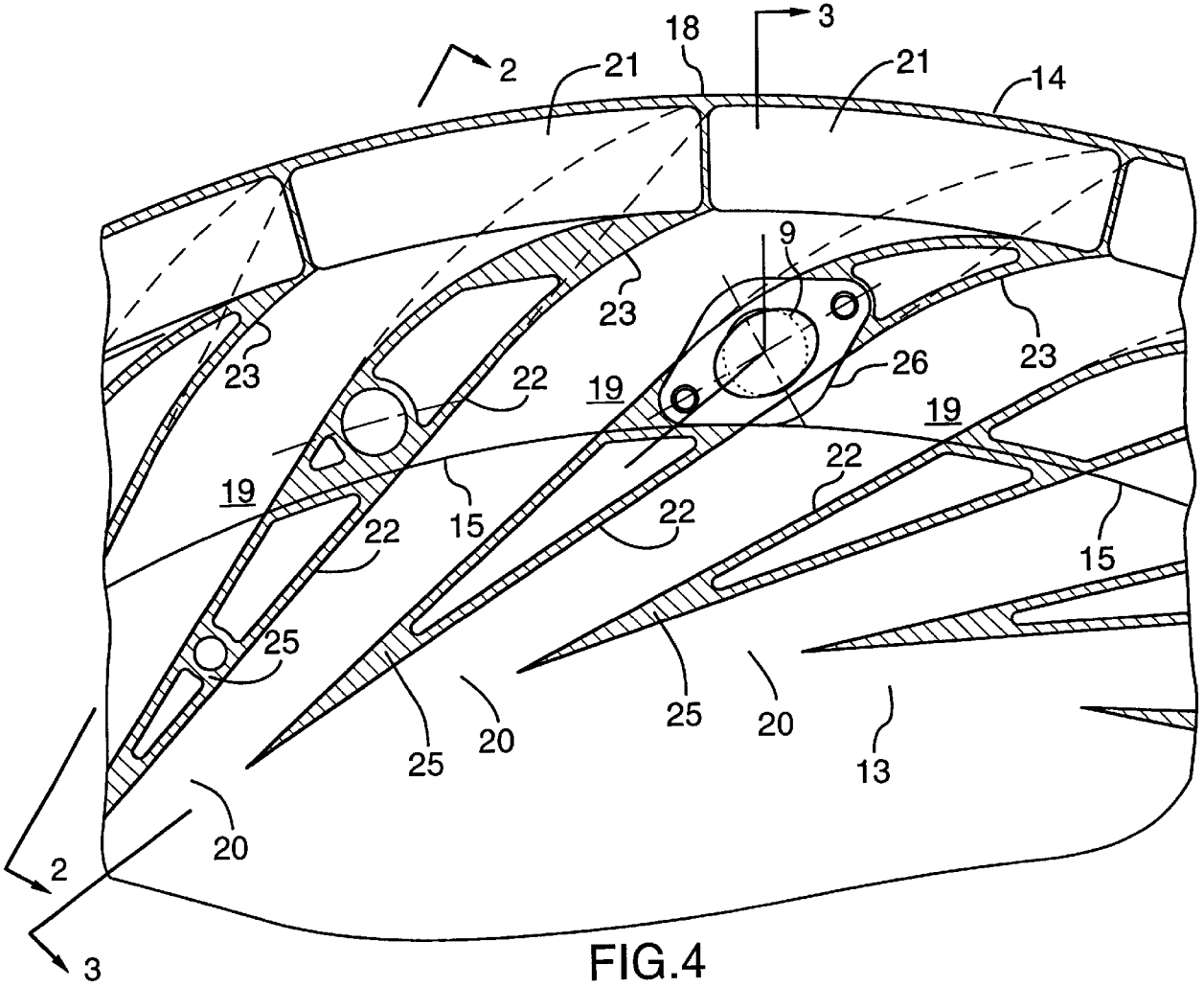
FIG. 4 is a partial radial sectional view along lines 4—4 of FIGS. 2 and 3.

Referring to FIG. 4, the sectional views shown in FIGS. 2 and 3 are indicated with lines 2—2 and 3—3 in FIG. 4. The diffuser assembly 3 has a central impeller opening 17 adjacent to the impeller 2 and an outer rim 18. The diffuser assembly 3 includes a plurality of discrete diffuser passages 19 disposed in a circumferentially spaced apart array through the diffuser assembly 3. Each passage 19 extends through the diffuser assembly 3 from an inlet 20 in the central opening 17 to an outlet 21 in the rim 18. Each diffuser passage 19 is intersected by and extends transversely across the joint 15. In the embodiment illustrated, the inner and outer casings 13 and 14 have cylindrical mating joint surfaces coaxial the impeller opening 17. It will be apparent that any joint configuration can be utilized, however for ease of machining and assembly mating surfaces with surfaces of revolution are most advantageous.

In the embodiment illustrated, the passages 19 have a circular cross-section at the inlet 20 and a rectangular cross-section at their outlet 21. This geometric configuration is familiar to designers and is utilized in conventional diffuser designs. It will be apparent however that the separate casting and machining of the inner casing 13 and outer casing 14 frees the designer to utilize any desired geometry for the passage ways 19. In conventional diffuser assemblies, a central ring includes a conically machined opening into which individual sheet metal diffuser tubes are braced. Machining of a conical shape is readily accomplished with conventional machinery and methods, and serves the diffusing purpose by expanding the cross-section of the diffuser passages 19 in a controlled predictable manner.

In the embodiment illustrated, each passage 19 has a conical internal surface 22 which extends from the circular inlet 20. To simplify machining of the inner casing 13, the embodiment illustrated includes a conical surface 22 extending through the entire inner casing 13 to the joint 15. Also in the particular embodiment illustrated, for simple machining and accurate fit of passages across the joint 15, the conical surface 22 extends across the joint 15 into the initial portion of the passage way 19 in the outer casing 14.

Each passage 19 has a circular to rectangular cross-section transition surface 23 from the outward boundary 24 of the conical surface 23 to the rectangular outlet 21. The conical surface 22 can have a highly accurate machined finish utilizing conventional machining methods. In contrast to conventional diffusers, the invention provides a relatively long conical machined surface 22 and locates the joint 15 at a position in the passage 19 where airflow speeds are relatively low compared to the speeds immediately adjacent to the inlet 20. Due to the low speed in the circular to rectangular cross-section transition surface area 23, the outer casing 14 can be manufactured from a metal casting and the transition surface 13 can be finished with exude honing methods.

With reference to FIGS. 3 and 4, the diffuser assembly 3 can include lands 25 between adjacent passages 19 due to the geometry of the passages 19. Conventional diffusers constructed of multiple individual diffuser tubes have an opening between diffuser tubes through which oil lines are passed through the diffuser. In the present invention, the lands can include a perforation through which an oil line 9 can be passed preferably secured with mounting flanges 26.

Figure 5:
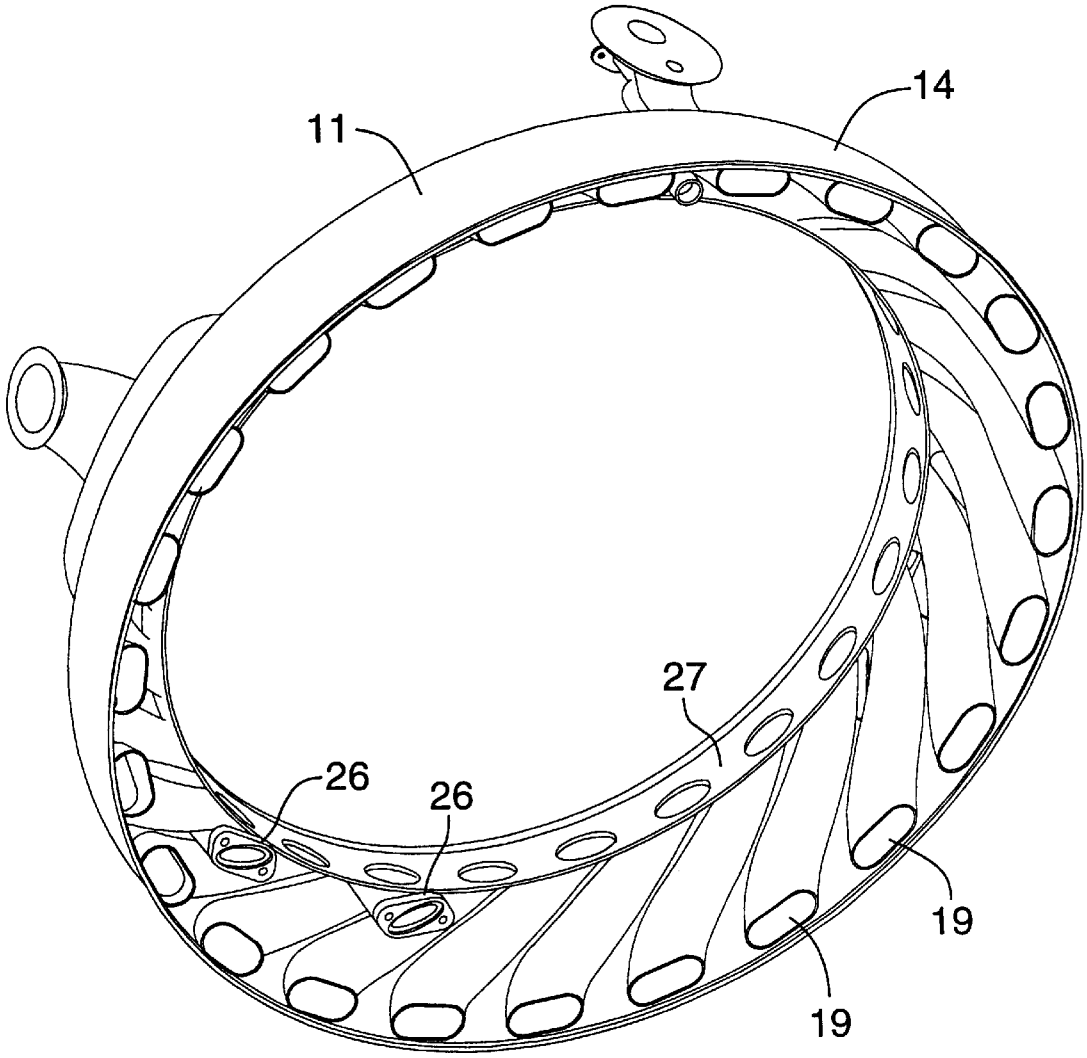
FIG. 5 is a perspective view of the outer casing of the diffuser assembly showing the internal cylindrical joint face which mates with the external cylindrical joint face of the inner casing.
Figure 6:
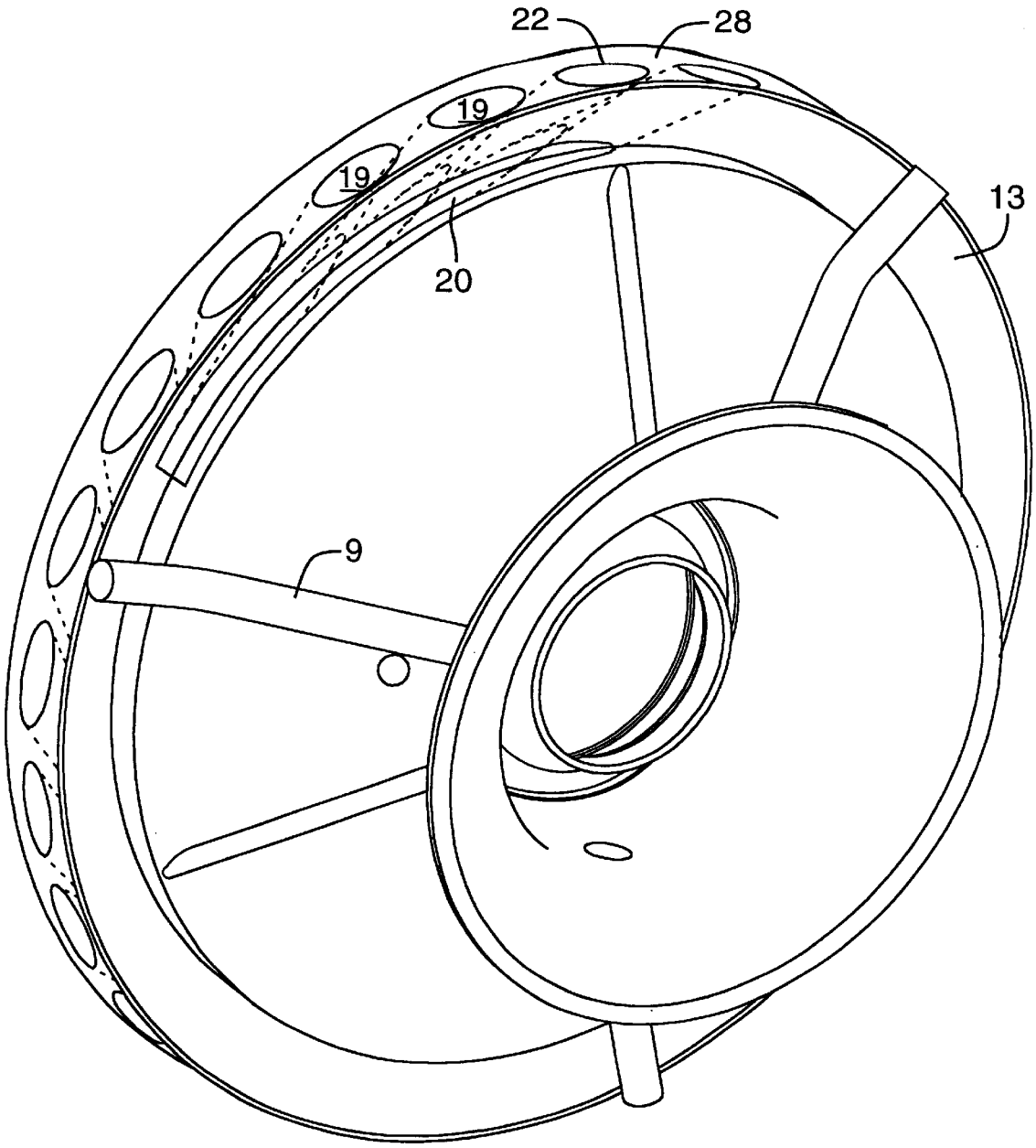
FIG. 6 shows a like perspective view of the inner casing showing the external joint surface with partial diffuser passage ways which mate the passage ways provided in the outer casing of FIG. 5 (note

With reference to perspective views in FIGS. 5 and 6, the separate construction of the inner casing 13 and outer casing 14 is best illustrated. The outer casing 14 can be cast with conventional methods as a metal ring with the external wall 11 being continuous and individual passages 19 formed within the unitary casting integral with the external wall 11. An internal cylindrical joint mating surface 27 is accurately machined to ensure close diametrical fitting with the external cylindrical joint surface 28 of the inner casing 13. The inner casing 13 can be formed as a casting or a machined ring. The conical surfaces 22 of passage ways 19 are machined in the inner casing 13 prior to fitting and securing the joint 15.

As described above, the present invention has distinctive advantages over conventional diffuser assemblies. The casting of the outer casing and inner casing significantly reduces the number of parts that must be accurately manufactured and fitted. The relocation of the transition within passages to the joint 15 radially outward relative to conventional diffusers reduces the airflow losses across the transition. Conventional diffusers include a transition relatively close to the inlet and suffer from the potential for significant airflow loses. The diffuser assembly 3 can be used as a structural component of the engine and a portion of a pressure vessel. The outer wall 11 of the present invention can serve to reinforce the structure of the engine, serve to act as a pressure vessel wall for the gas generator casing 4 and is significantly reinforced by the walls of the passages 19 which serve as reinforcing ribs for the outer wall 11 shell structure. The structural integrity of the outer casing 14 in particular eliminates the dynamic instability experienced with conventional diffusers that use individual diffuser tubes. Due to the use of castings, the geometry of the passageways 19 can have greater independence from the fabrication methods than conventional diffuser tubes.

As described above therefore, the present invention provides several advantages over conventional diffusers at reduced costs and reduced complexity. Although the above description and accompanying drawings relate to a specific preferred embodiment as presently contemplated by the inventors, it will be understood that the invention in its broad aspect includes mechanical and functional equivalents of the elements described and illustrated.

We claim:

1. A radial split diffuser, for directing a radially outward flow of compressed air from an impeller of a centrifugal compressor to an axially rearward diffused annular flow, the split diffuser comprising:

an annular diffuser assembly having a central impeller opening and an outer rim, a plurality of discrete diffuser passages disposed in a circumferential spaced apart array through the diffuser assembly, each passage extending through the diffuser assembly from an inlet in the central opening to an outlet in the rim;

the diffuser assembly comprising an inner casing and an outer casing joined together along a joint, each diffuser passage being intersected by and extending transversely across the joint;

wherein the diffuser assembly includes lands between adjacent passages, including a perforation extending through the lands.

2. A radial split diffuser according to claim 1 wherein the inner and outer casings have mating surfaces of revolution coaxial the impeller opening.

3. A radial split diffuser according to claim 2 wherein each mating surface is cylindrical.

4. A radial split diffuser according to claim 1 wherein the joint is brazed.

5. A radial split diffuser according to claim 1 wherein the joint is press fit.

6. A radial split diffuser according to claim 1 wherein the joint is secured with fasteners.

7. A radial split diffuser according to claim 1 wherein the passages each have a circular cross-section at their inlet, and a rectangular cross-section at their outlet.

8. A radial split diffuser according to claim 7 wherein each passage has a conical internal surface extending from said circular inlet.

9. A radial split diffuser according to claim 8 wherein said conical surface extends through the entire inner casing to the joint.

10. A radial split diffuser according to claim 9 wherein said conical surface extends across the joint into the outer casing.

11. A radial split diffuser according to claim 8 wherein said conical surface has a machined finish.

12. A radial split diffuser according to claim 8 wherein each passage has a circular-to-rectangular cross-sectional transition surface from an outward boundary of said conical surface to the rectangular outlet.

13. A radial split diffuser according to claim 12 wherein the circular-to-rectangular cross-sectional transition surface has an exude honed surface.

14. A radial split diffuser according to claim 1 wherein the diffuser assembly includes lands between adjacent passages.

15. A radial split diffuser according to claim 1 wherein the perforation includes an oil line.

16. A radial split diffuser according to claim 1 wherein the inner casing comprises a machined ring.

17. A radial split diffuser according to claim 1 wherein the outer casing comprises a cast metal ring.

18. A radial split diffuser, for directing a radially outward flow of compressed air from an impeller of a centrifugal compressor to an axially rearward diffused annular flow, the split diffuser comprising:

an annular diffuser assembly having a central impeller opening and an outer rim, a plurality of discrete diffuser passages disposed in a circumferential spaced apart array through the diffuser assembly, each passage extending through the diffuser assembly from an inlet in the central opening to an outlet in the rim;

the diffuser assembly comprising an inner casing and an outer casing joined together along a joint, each diffuser passage being intersected by and extending transversely across the joint;

wherein a wall of the diffuser assembly comprises a pressure vessel component.

19. A radial split diffuser, for directing a radially outward flow of compressed air from an impeller of a centrifugal compressor to an axially rearward diffused annular flow, the split diffuser comprising:

an annular diffuser assembly having a central impeller opening and an outer rim, a plurality of discrete diffuser passages disposed in a circumferential spaced apart array through the diffuser assembly, each passage extending through the diffuser assembly from an inlet in the central opening to an outlet in the rim;

the diffuser assembly comprising an inner casing and an outer casing joined together along a joint, each diffuser passage being intersected by and extending transversely across the joint;

wherein a wall of the diffuser assembly comprises a engine structure component.

* * * * *